US005794283A

United States Patent [19]

Vila et al.

[11] Patent Number: 5,794,283

[45] Date of Patent: Aug. 18, 1998

[54] CONVERTIBLE FURNITURE

[76] Inventors: Jose E. Vila; Elina M. Vila, both of 2678 West 60 St., Hialeah, Fla. 33016-4724

[21] Appl. No.: 986,352

[22] Filed: Dec. 8, 1997

[51] Int. Cl.[6] ..... A47C 17/13

[52] U.S. Cl. ..... 5/18.1; 5/58

[58] Field of Search ..... 5/18.1, 17, 58, 5/308

[56] References Cited

U.S. PATENT DOCUMENTS

| | | | |
|---|---|---|---|
| 2,692,009 | 10/1954 | Warshaver | 5/58 |
| 4,366,585 | 1/1983 | Ponti et al. | 5/18.1 |
| 4,473,254 | 9/1984 | Secon | 5/18.1 |
| 4,481,684 | 11/1984 | Hauck | 5/18.1 |

FOREIGN PATENT DOCUMENTS

| | | | |
|---|---|---|---|
| 768234 | 2/1957 | United Kingdom | 5/58 |

*Primary Examiner*—Alexander Grosz
*Attorney, Agent, or Firm*—J. Sanchelima

[57] ABSTRACT

A convertible furniture that in one configuration is a bed and in another is a chair, coach or sofa, depending on its dimensions. Telescopically mounted housing members extend out a sufficient amount to define an upper surface over which cushions are positioned to provide a suitable horizontal resting surface. The upper surface is defined with hingedly mounted closure members that cover a storage cavities below. One of the closures at one end includes a frame with one of its sides being slidably mounted to the underside of the closure. The opposite side of the frame is hingedly mounted to the inner wall of the cavity of the largest housing member. The underside of the closure includes a stop member against which the sliding side of the frame engages when it reaches a predetermined position. Two cord or flexible elongated members are attached to the upper end of the frame so that a user by pulling it causes the collapse of the closure back to the horizontal position.

9 Claims, 4 Drawing Sheets

CONVERTIBLE FURNITURE

BACKGROUND OF THE INVENTION

1. Field of the Invention.

The present invention relates to a convertible furniture, and more particularly, to the furniture that can be used as a bed or as a chair.

2. Description of the Related Art.

Many designs for furniture that selectively convert from a couch or sofa to a bed, and vice versa, have been designed in the past. However, none of these designs include the novel characteristics of the present invention. The suitability for the elderly and handicapped makes it unique in that telescopically housed assemblies are readily extended outwardly to form the bed configuration. A user does not need to reach down or lift heavy weights.

Rather, he or she simply pulls out, horizontally, its outermost housing or member that rolls out. Cooperative closures are mounted on the upper side of the extended telescopically housing member to define a flat surface over which cushion are placed. An inner cavity is defined below the closures to store linen items.

SUMMARY OF THE INVENTION

It is one of the main objects of the present invention to provide a furniture that has such a mechanism that permits a user to readily convert the furniture from a chair into a bed and vice versa. This feature carries the advantage of a volumetrically efficient furniture with the flexibility of providing different functions.

It is another object of this invention to provide a furniture that includes cushion members that are used as the resting surface in the bed configuration.

It is still another object of the present invention to provide a furniture with the cushion members having cooperative shape that can be used to define suitable and selectable resting surfaces.

It is another object of this invention to provide a device that can be easily operated by the elderly and the handicapped.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
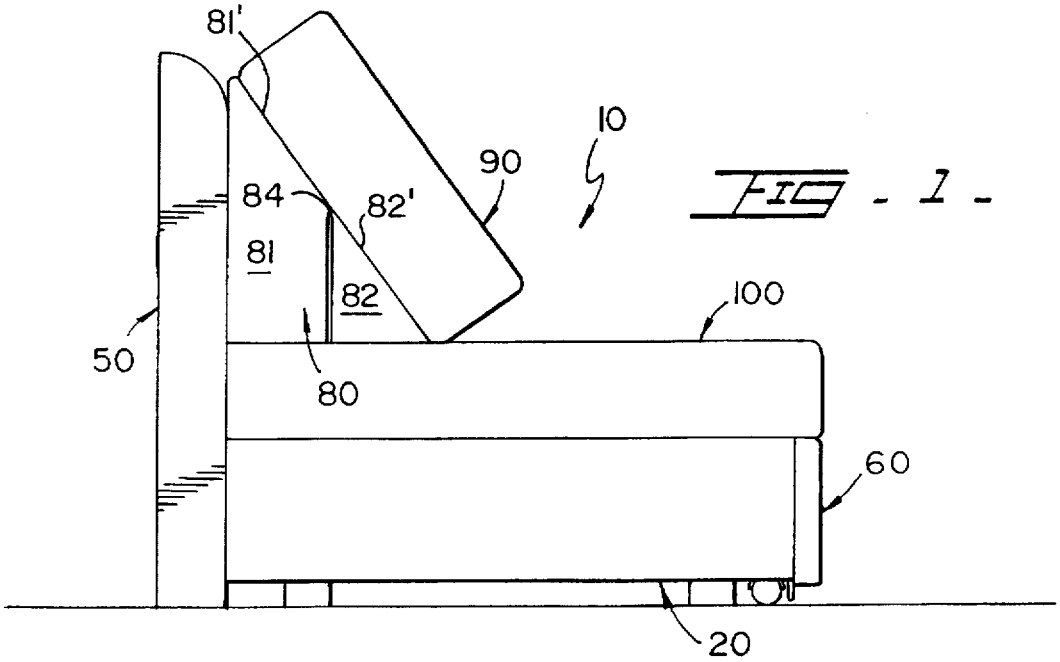
FIG. 1 is an elevational side view of the present invention.

Referring now to the drawings, where the present invention is generally referred to with numeral 10, it can be seen that it basically includes main housing assembly 20, extension housing assembly 40 and extension support assembly 60, telescopically housed within each other. Back rest 50 is mounted perpendicularly at one end of main housing 20. Cushion members 80; 90 and 100 are supported by the upper sides of main housing 20, extension housing assembly 40 and extension support assembly 60.

Figure 3:
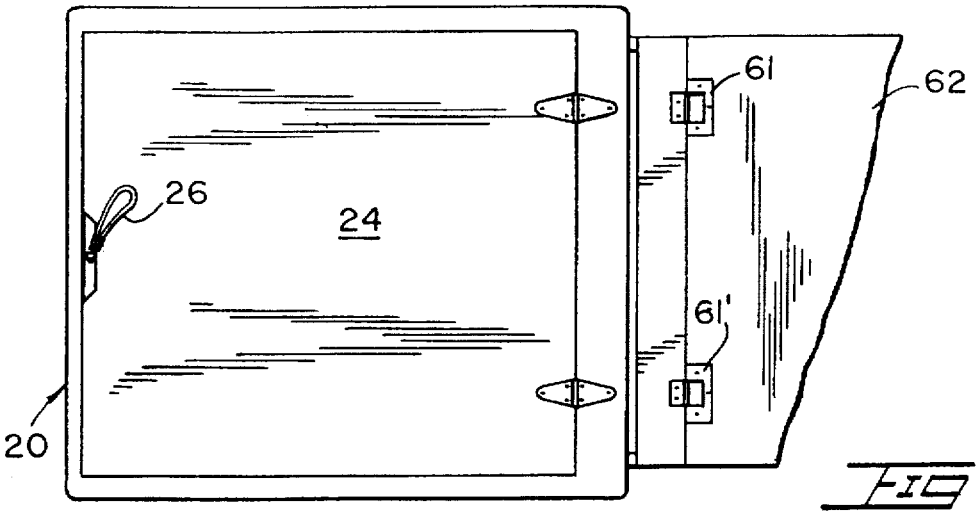
FIG. 3 is a partial top view of the housing assembly without the cushion members mounted thereon.
Figure 2:
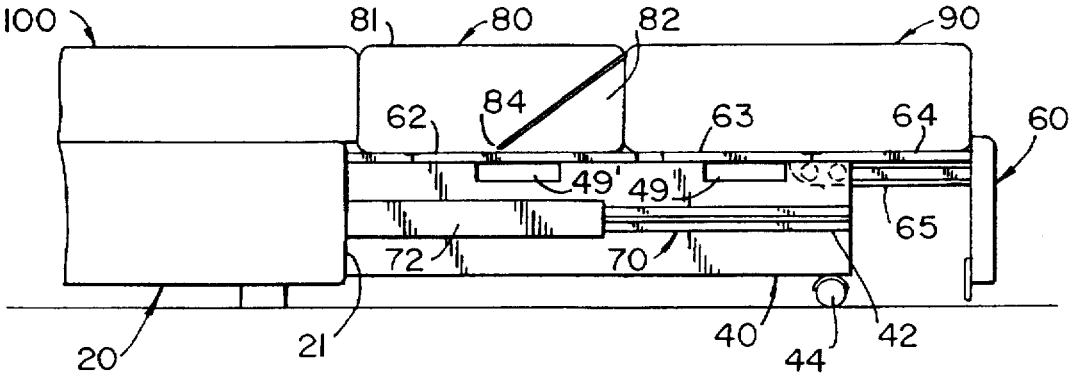
FIG. 2 is a partial elevational side view of this invention previously shown but illustrating it in extended bed position.

Main housing assembly 20, in the preferred embodiment, has a substantially projected rectangular shape and is sufficiently large to cooperatively receive extension housing assembly 40 having also a substantial rectangular shape as seen in FIGS. 1 and 3. Extension housing assembly 40 is telescopically received inside main housing assembly 20. Assembly 40 protrudes out through opening 21 and is guided by guiding assembly 70, as best seen in FIG. 2.

Figure 4:
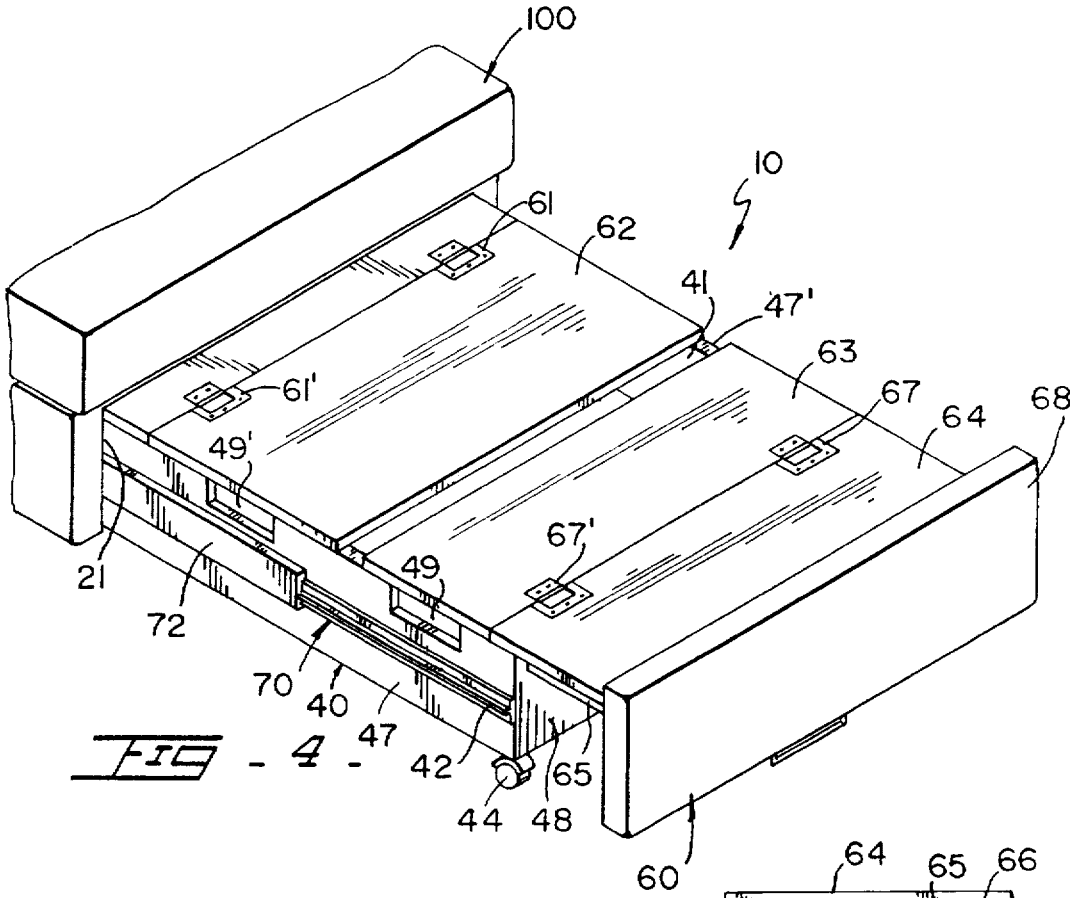
FIG. 4 is a partial isometric view of the furniture.

Extension housing assembly 40 and extension support assembly 60 are designed to permit the extension of the resting surface of furniture 10 thereby forming the bed configuration. Extension housing assembly 40, as illustrated in FIGS. 2; 4; 6 and 8, is a boxed structure with cavity 41 that permits a user to store linen items, for instance. Assembly 40 is covered at the top with closures 62 and 63 of extension support assembly 60. Closure 62 is mounted to assembly 20 with hinge members 61 and 61'. Closure 63 is hingedly mounted to closure 64 with hinge members 67 and 67'. Apertures 49 and 49' are designed to aid a user to lift closures 62 and 63, as shown in FIG. 4. Extension housing assembly 40 includes rails 42 rigidly mounted to lateral walls 47 and 47' of assembly 40. Rails 42 are designed to slide along guiding members 72 that are also mounted to lateral walls 47 and 47'. In this manner, and in cooperation with roller casters 44, extension housing assembly 40 can be easily (and with a minimum of user's effort) extended out from main housing assembly 20. Then, extension support assembly 60 is pulled out to achieve the maximum extension for furniture 10 to be converted into a bed. Finally, cushion members 80 and 90 are placed on top of closures 62 and 63, respectively.

Figure 5:
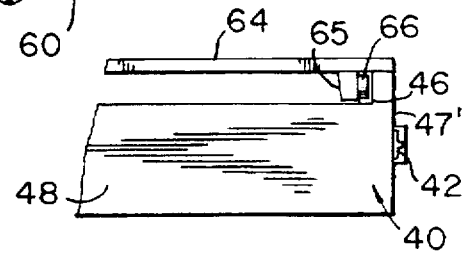
FIG. 5 is a partial front view of the extension housing assembly showing a guiding assembly.
Figure 6:
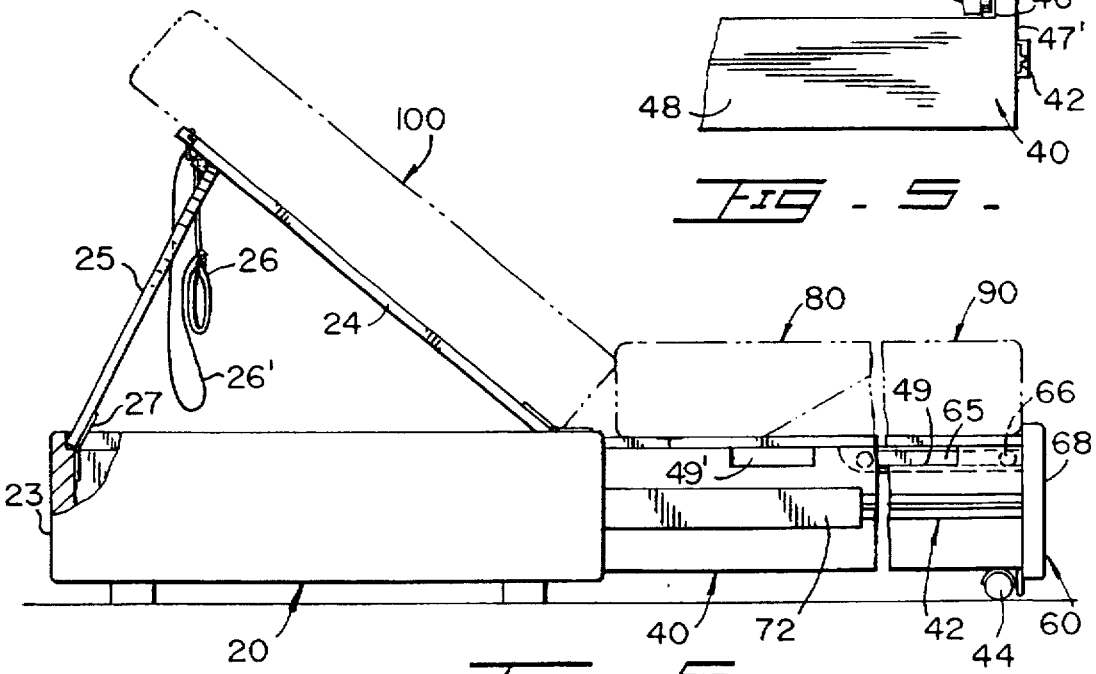
FIG. 6 is a partial elevational view of this invention, showing another configuration.

Extension support assembly 60 is telescopically mounted within extension housing assembly 40 as seen in FIGS. 1;2;4 and 6. Extension support assembly 60 includes elongated members 65 mounted to the underside of resting plate 64 and are located at spaced apart and parallel relationship with respect to each other as seen is FIG. 5. Elongated members 65 have rollers 66 that travel within guiding members 46. Guiding members 46 are rigidly mounted to the inner surface of the lateral walls of housing assembly 40, as best in FIGS. 5 and 6. When extension support assembly 60 is retrieved to convert furniture back to a chair or sofa, closure 63 is folded on top of plate 64. In this manner, cover member 68 of extension support assembly 60 can be brought against front wall 48 of housing assembly 40, as best seen in FIG. 6. Resting plate 64 is brought above cavity 41 of housing assembly 40.

Figure 7:
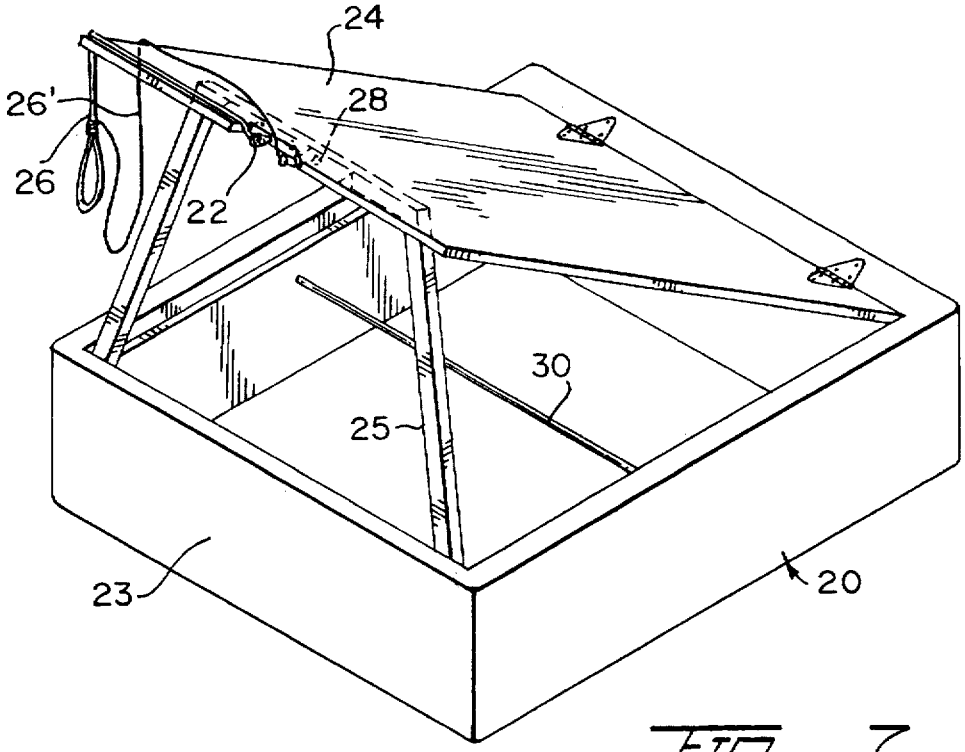
FIG. 7 is an isometric view of the main housing assembly with a frame supporting a closure at an angle with respect to a horizontal plane.
Figure 9:
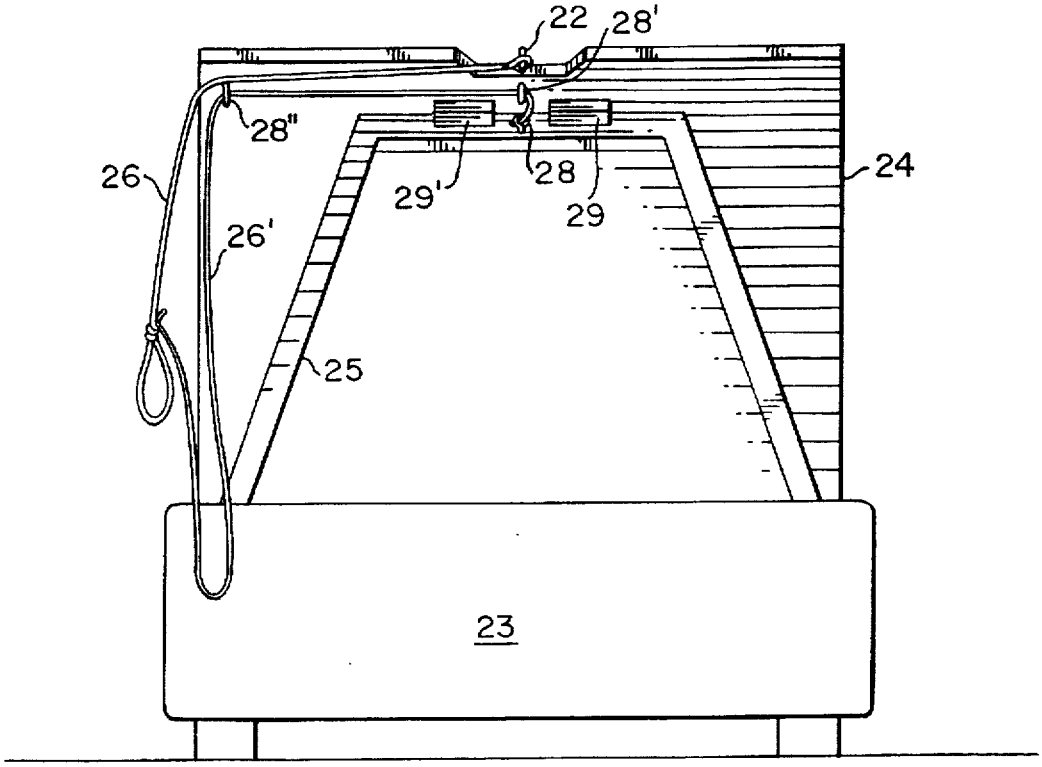
FIG. 9 is an elevational rear view of the main housing assembly previously shown in FIG. 7.

Main housing assembly 20 also has closure 24 hingedly mounted thereto with hinge members. Cushion member 100 is cooperatively positioned above closure 24. Closure 24, in the preferred embodiment, co-acts with frame 25 that is hingedly mounted to the inner side of rear wall 23 of housing assembly 20 with hinge member 27 as best seen in FIGS. 6 and 7. Once a user desires to lift (the back resting surface), to read or watch TV, for example, cord 26 is pulled lifting closure 24. Closure 24 includes stopper members 29 and 29' that are mounted to the underside of closure 24 and stop the travel of the uppermost portion of frame member 25, as best seen in FIG. 9. Cord 26 is tied, at one end, to eyelet 22 and the free end is shaped into a handling loop that permits a user to actuate it. Cord 26 is then used to pivotally move closure 24. A second cord 26' is tied, at one end, to the handling loop of cord 26 and to eyelet 28 at the other end. Cord 26' passes through guiding eyelets 28 ' and 28" which are rigidly mounted to the underside of closure member 24. In this manner, when a user pulls cord 26, attached cord 26" simultaneously brings frame member 25 up. The angle set between frame member 25 and closure 24 and thus the inclination of cushion member 100 depends on the user's desire and dimensions of frame member 25. Additional stopper members 29 and 29' can be mounted to the underside of closure member 24 that provide a user the desire angle of inclination of cushion member 100. When closure member 24 collapses, it falls on bar 30 that is mounted inside housing 20, as seen FIG. 7.

Figure 10:
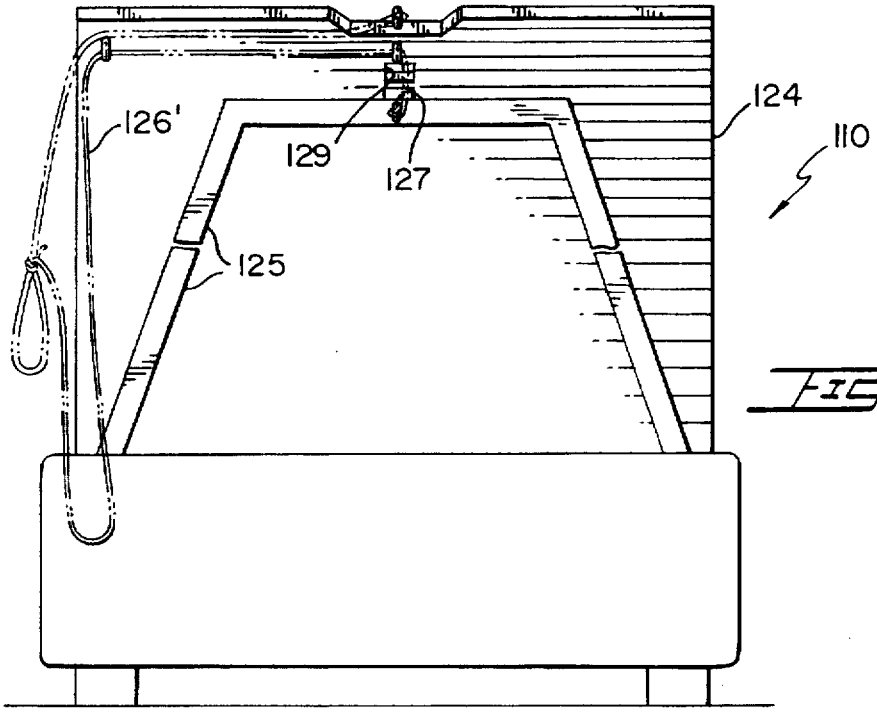
FIG. 10 is an elevational rear view of a main housing assembly of an alternative embodiment.

FIG. 10 shows alternative embodiment 110 with closure 124 and frame member 125. Pulling cord 126' brings the upper edge of frame 125, and thus locking protrusion 127 towards cooperating locking hole 129, and once reached, protrusion 127 is inserted in hole 129 locking closure 124 in place.

Figure 8:
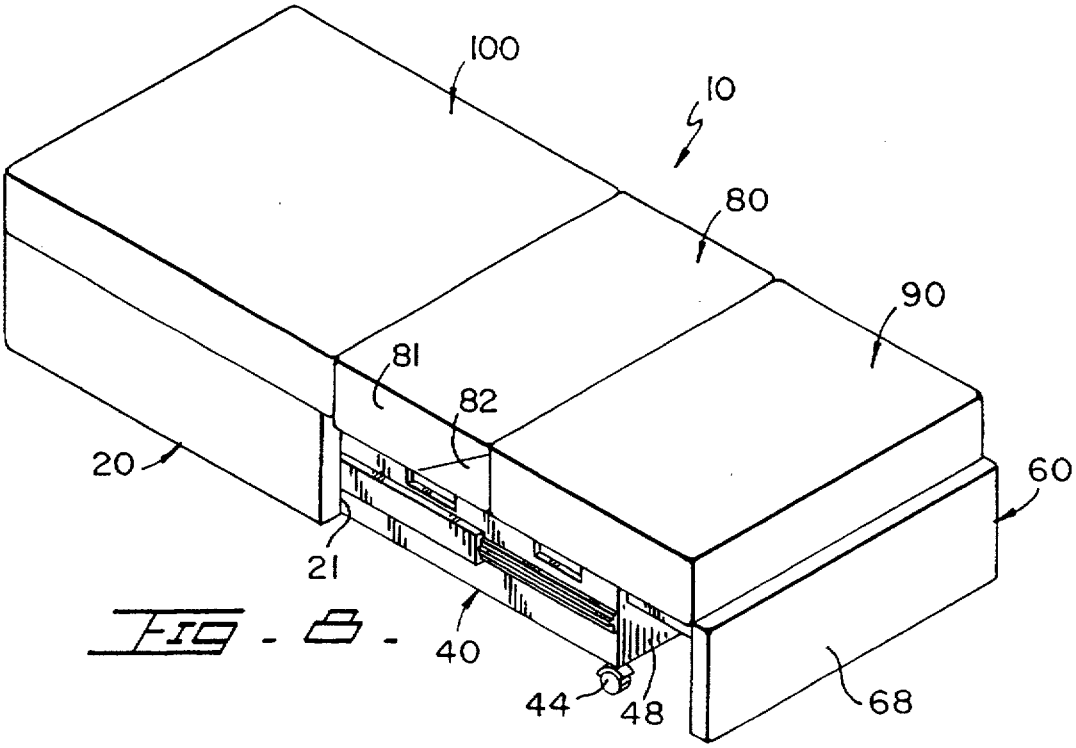
FIG. 8 is an isometric view from the top of this invention showing the furniture converted into a bed.

Furniture 10, as shown in FIGS. 1 and 8, includes cushion members 80; 90 and 100. Cushion members 90 and 100 have a substantial rectangular box configuration. Cushion member 80, in the preferred embodiment, includes cushion portions 81 and 82 that are hingedly connected to each other through edge 84 so that they can configure a triangle, as shown in FIG. 1, or a rectangle as shown in FIGS. 2 and 8, thus enhancing the versatility of the furniture. Cushion portion 82 has a substantially triangular cross-section of cooperative dimensions to complement cushion portion 81 to form, in combination, cushion member 80 in one configuration with a combined rectangular cross-section. In the other configuration, cushion portion 82 is flipped and its longer surface 82' is aligned in the same plane as surface 81'. In this configuration, the combination of portions 81 and 82 form a body with a combined triangular cross-section.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A furniture that is selectably convertible between a bed and chair resting on a horizontal surface, comprising:

A) first housing means having a substantially rectangular projected shape defining a first cavity therein, with first and second ends including a first peripheral upper edge aligned in a substantially horizontal plane and defining a first opening and further including a first upper flat closure member and said first end including an aperture;

B) second housing means having third and fourth ends and being slidably housed within said first housing means, having a substantially rectangular projected shape, including a second peripheral upper edge aligned in a substantially horizontal plane and defining a second opening and a second cavity therein, and further including a second upper flat closure member for selectively closing said second opening;

C) an extension support member telescopically housed within said second housing means further including a third peripheral upper edge aligned in a substantially horizontal plane and further including a third upper flat closure member hingedly mounted on said third peripheral upper edge;

D) first guiding means for slidably extending said second housing means outwardly from said first housing means;

E) second guiding means for slidably extending said extension support member outwardly from said second housing means; and F) a cushion assembly cooperatively and removably mounted on said first, second and third upper flat closure members, so that a substantially horizontal resting surface is provided.

2. The furniture set forth in claim 1 wherein said cushion assembly includes at least one cushion member comprising a wedge with a substantially triangular cross-section.

3. The furniture set forth in claim 2 wherein said first upper flat closure member is hingedly mounted to said first housing means.

4. The furniture set forth in claim 3 wherein said first housing means further includes locking means for keeping said first upper flat closure member at an angle with respect to said horizontal surface.

5. The furniture set forth in claim 4 wherein said first housing means includes flexible means for releasing said locking means.

6. The furniture set forth in claim 5 wherein said locking means includes a frame member having an uppermost member pivotally mounted within said first cavity, including a locking protrusion on said uppermost member and said first upper flat closure member includes a cooperating locking hole, and further including flexible means for releasing said locking protrusion from said locking hole.

7. The furniture set forth in claim 6 wherein said second housing means includes a supporting wheel assembly.

8. The furniture set forth in claim 5 wherein said locking means includes a frame member having an uppermost member pivotally mounted within said first cavity, including at least one stopper member for cooperatively holding said frame member at a predetermined angle, and further including flexible means for releasing said uppermost member from said stopper member.

9. The furniture set forth in claim 8 wherein said second housing means includes a supporting wheel assembly.

* * * * *